United States Patent [19]

Iijima et al.

[11] Patent Number: 4,459,196

[45] Date of Patent: Jul. 10, 1984

[54] ELECTROLYTIC CELLS

[75] Inventors: Tokuzo Iijima, Kobe; Yasushi Samejima, Kakogawa; Kazuo Kishimoto, Takasago; Toshiji Kano; Kiyoshi Yamada, both of Kobe; Yoshio Hatta, Takasago, all of Japan

[73] Assignee: Kanegafuchi Kagaku Kogyo Kabushiki Kaisha, Osaka, Japan

[21] Appl. No.: 207,201

[22] Filed: Nov. 14, 1980

[30] Foreign Application Priority Data

Nov. 14, 1979 [JP] Japan ..... 54-158516[U]

[51] Int. Cl.[3] ..... C25B 15/08; C25B 9/00; C25B 1/16

[52] U.S. Cl. ..... 204/258; 204/266; 204/98

[58] Field of Search ..... 204/263–266, 204/257–258, 255–256, 98, 128

[56] References Cited

U.S. PATENT DOCUMENTS

| | | | |
|---|---|---|---|
| 3,057,794 | 10/1962 | Carlin | 204/252 |
| 4,017,376 | 4/1977 | Mosé et al. | 204/266 X |
| 4,064,021 | 12/1977 | de Nora et al. | 204/128 X |
| 4,065,367 | 12/1977 | de Nora | 204/128 X |
| 4,140,615 | 2/1979 | Kadija et al. | 204/266 |
| 4,144,161 | 3/1979 | Bourgeois | 204/266 X |
| 4,155,821 | 5/1979 | Grontoft | 204/266 X |
| 4,177,116 | 12/1979 | de Nora et al. | 204/252 X |
| 4,204,920 | 5/1980 | Kurtz et al. | 204/128 X |
| 4,211,627 | 7/1980 | Cunningham | 204/254 X |
| 4,263,119 | 4/1981 | Mose et al. | 204/257 |
| 4,265,719 | 5/1981 | Ezzell et al. | 204/266 X |

*Primary Examiner*—Donald R. Valentine

*Attorney, Agent, or Firm*—Armstrong, Nikaido, Marmelstein & Kubovcik

[57] ABSTRACT

Disclosed is a vertical and monopolar box type electrolytic cell for the electrolysis of an aqueous alkali metal chloride solution providing a cation exchange membrane as a separator between anodes and cathodes, which comprises an anode compartment having at least one anode solution inlet, at least one anode solution outlet and at least one anode gas outlet, respectively, and a cathode compartment having at least one cathode solution inlet, at least one cathode solution outlet and at least one cathode gas outlet, respectively, said anode solution outlet is positioned in such a manner that the ratio of height of anode solution level to that of cathode solution level is more than one and the product of a difference in height between the cathode solution level and the anode solution level and an apparent specific gravity of the anode solution is less than the sum total of an anode compartment inside pressure in the positive numerical value of a given negative pressure value and a cathode compartment inside pressure during the course of the operation.

4 Claims, 3 Drawing Figures

ELECTROLYTIC CELLS

DETAILED DESCRIPTION OF THE INVENTION

The present invention relates to a novel electrolytic cell. More specifically, it relates to a vertical and monopolar box type electrolytic cell which is capable of uniformity of anode solution (i.e., brine) and cathode solution (i.e., caustic alkali), prevention of diffusion of chlorine gas evolved into a cathode compartment through a cation exchange membrane and operation at a low voltage, while eliminating a risk of leakage of hydrogen gas into an anode compartment.

As a process for the electrolysis of an alkali metal chloride, a process has recently been proposed which employs a cation exchange membrane. It is well-known to the art that a filter type electrolytic cell is suitable as an electrolytic cell employing the cation exchange membrane.

However, a conventional process for the production of an alkali metal hydroxide using the filter press type electrolytic cell providing the cation exchange membrane as a separator has numerous drawbacks as stated below and is therefore dreadfully disadvantageous in the industry.

(1) Because of low productivity per a cell, a great number of cells have to be operated and controlled.

(2) A large amount of anode or cathode solution has to be circulated to each cell to provide a uniform concentration in every cell, thereby equipment cost being increased.

(3) Every cell has numerous joint portions from which leakage is likely to take place.

(4) Recirculation of anolyte or catholyte causes leakage of electric current, which leads to loss in current efficiency and corrosion of the equipment.

(5) Separation of chlorine gas in the filter press type electrolytic cell is complicated since anode solution containing bubbles of chlorine gas is discharged from the cell and led to a gas-liquid separator where chlorine gas is separated from the anode solution.

(6) In the filter press type electrolytic cell, the anode compartment is linked to the gas-liquid separator with a pipe having a diameter smaller than the sectional area of the anode compartment so that chlorine gas is liable to reside therein. The resident chlorine invites an increase in cell voltage and is transported into the cathode compartment through the cation exchange membrane to degrade quality of an alkali metal hydroxide produced in the cathode compartment. That is, a cation exchange membrane represented by "NAFION" manufactured and sold by E. I. Du Pont de Nemours & Company permits substantially no passage of hydrodynamic flow but permits passage or diffusion of chlorine readily. Hence, if the zone of chlorine gas is in contact with the cation exchange membrane, chlorine gas diffuses into the cathode compartment in which the following reaction takes place;

$$Cl_2 + 2NaOH \rightarrow NaCl + NaOCl + H_2O$$

$$NaOCl + H_2 \rightarrow NaCl + H_2O$$

Accordingly NaCl increases in the cathode solution, thereby resulting in degradation of caustic alkali.

As set forth above, filter press type electrolytic cells have numerous drawbacks in respect of operational control and quality of the product.

Japanese Patent Non-examined Publication No. 109,899/1975 discloses an electrolytic process of an aqueous alkali metal chloride solution using a cation exchange membrane. According to the process, the electrolysis is effected in a way that a cation exchange membrane is positioned nearer to an anode than a cathode, for which purpose a positive pressure of 0.1 to 20 psi (70 mm to 14,000 mm) is exerted on the cathode side.

Nevertheless, in a vertical and monopolar box type electrolytic cell of the present invention a cation exchange membrane is fixed physically to an upper membrane support and at the cathode side of the membrane is a space where hydrogen gas is present. Exertion of a high positive pressure on the cathode side never fails to increase a risk of leakage of hydrogen gas into the anode compartment and thus it was found not to be an industrially safe electrolytic cell.

The present inventors have made a series of studies in an attempt to provide an electrolytic cell of high safety and of low cell voltage which is capable of making uniform of anode and cathode solutions very readily, allowing no residence of chlorine gas in the neighborhood of the membrane, in consequence, to prevent chlorine gas from diffusing through the membrane into the cathode compartment, minimizing a net pressure exerted on the space containing hydrogen gas of the cathode compartment, thereby to be free of leakage of hydrogen gas into the anode compartment, while eliminating the foregoing drawbacks, and have found that the foregoing objects are achieved by the present invention without such defects as aforesaid.

That is, the present invention is to provide a vertical and monopolar box type electrolytic cell for the electrolysis of an aqueous alkali metal chloride solution equipped with a cation exchange membrane as a separator between anodes and cathodes which comprises an anode compartment having at least one anode solution inlet, at least one anode solution outlet and at least one anode gas outlet, respectively, and a cathode compartment having at least one cathode solution inlet, at least one cathode solution outlet and at least one cathode gas outlet, respectively, said anode solution outlet is positioned so that the ratio of height of anode solution level to that of cathode solution level is more than one and the product of a difference in height between the cathode solution level and the anode solution level and an apparent specific gravity of the anode solution is less than the sum total of an anode compartment inside pressure in the positive numerical value of a given negative pressure value and a cathode compartment inside pressure during the course of the operation.

By so particularly constructed electrolytic cell, the foregoing disadvantages associated with a conventional filter press type electrolytic cell are perfectly eliminated and outstanding and surprising effects are attained that not only the concentrations of the anode and the cathode solutions are maintained uniform, but also chlorine gas is prevented from diffusing into the cathode compartment during the course of operation, and further caustic alkali of high quality is produced with operation in high safety and at low cell voltage.

In the present electrolytic cell at least one cathode or anode solution inlet is positioned at the cathode or the anode compartment, respectively. Although such an inlet may be located at any portion from the upper to lower portion of the respective compartment, it should be located at the lower portion of each compartment in order that dissolution of evolved gas into the anode or the cathode solution is avoided, the concentration of the anode or the cathode solution is equalized and further these solutions are effectively circulated by evolved gas.

One inlet to each compartment suffices but it is preferred to locate two or more inlets to respective compartment in order to provide the uniform concentration of the anode or cathode solution and to cause circulating movement of both solutions, as mentioned earlier.

In the present electrolytic cell at least one cathode or anode solution outlet is positioned at the respective compartment. The anode solution outlet is positioned at the anode compartment so that the ratio of height of anode solution level to that of cathode solution level is more than one, and the product of a difference in height between the cathode solution level and the anode solution level and an apparent specific gravity of the anode solution is less than the sum total of an anode compartment inside pressure in the positive numerical value of a given negative pressure value and a cathode compartment inside pressure during the course of the operation.

In the operation on an industrial scale, the anode compartment is under a negative pressure between 10 and 30 mm $H_2O$ to prevent leakage of chlorine gas to the outside of the cell, inversely, the cathode compartment is under a positive pressure between 50 and 150 mm $H_2O$ to avoid entrance of air to commingle with hydrogen gas. When the electrolysis is effected under the conditions, a net positive pressure between 60 and 180 mm $H_2O$ is exerted on the cation exchange membrane above the cathode solution level (i.e., space containing hydrogen gas) and the membrane secured portion of the upper membrane support. It is dangerous in industry to exert such a high pressure on the portion in contact with the space containing hydrogen gas. The present electrolytic cell therefore intends to obtain the pressure required to negate the foregoing positive pressure from the hydraulic pressure resulting from a difference in height of the anode solution level and the cathode solution level.

That is, the position of the anode solution outlet is decided upon relatively so as to satisfy the following equation;

$$0 \leqq \{PC+PA\}-H\times\rho \leqq 30 \text{ mm } H_2O$$

wherein,

PC: Cathode hydrogen gas pressure (mm $H_2O$)

PA: Anode chlorine gas pressure in the positive numerical value (mm $H_2O$)

H: Height of the anode solution level from that of the cathode solution level (mm)

$\rho$: Apparent specific gravity of the anode solution

In the present electrolytic cell, the anode solution outlet is so particularly located at the anode compartment that chlorine gas evolved in the anode compartment ascends rapidly without residence in the anode solution in contact with the cation exchange membrane and then is separated from the anode solution, and a low pressure below 30 mm $H_2O$ is only exerted on the cation exchange membrane contacting with hydrogen gas and the membrane secured portion of the upper membrane support, thereby a secure electrolytic cell being provided. In electrolysing an aqueous alkali metal halide solution using the present electrolytic cell, a positive pressure between 0 and 30 mm $H_2O$ plus hydrostatic pressure resulting from the difference in apparent specific gravity is exerted on the central or lower portion of the cation exchange membrane, if the cathode solution is controlled to always have apparent specific gravity greater than that of the anode solution.

One outlet is sufficient for the respective compartment but two or more are preferred since separation of chlorine gas from the anode solution is expedited, in consequence, the diffusion of chlorine gas into the cathode solution is prevented more effectively. The cathode solution outlet may be located at any portion from upper to lower portion, but it is advantageous industrially to locate it at lower portion since separation of hydrogen gas generated in the cathode compartment from the cathode solution is possible in the inside of the cathode compartment, thus requiring neither gas-liquid separator nor gas-liquid separation. One cathode solution outlet may be adequate but two or more are preferred in respect of gas-liquid separation, uniform concentration and circulating movement of the cathode solution.

Furthermore, in the electrolytic cell of the present invention a gas outlet is positioned at the respective compartment. The gas outlets for removing gas generated in the anode compartment (chlorine gas) and for removing gas evolved in the cathode compartment (hydrogen gas) are respectively located at uppermost portions of the anode and the cathode compartments, through which accompaniment of the anode or the cathode solution is prohibited. One gas outlet may be adequate for each compartment but two or more should be located to more effectively prevent the accompaniment of solutions as aforesaid.

The purpose of the present invention is also accomplished, even when the gas outlet in the anode compartment is not specifically provided, by removing gas evolved together with the anode solution through the anode solution outlet.

The present invention is therefore exceedingly useful in industry since in the inside of the electrolytic cell gas-liquid separation is effected, operation is carried out at the uniformly concentrated anode or cathode solution, a disadvantage that chlorine gas passes through the cation exchange membrane to deteriorate the quality of the cathode solution is eliminated, and it is operated very securely and at low cell voltage.

As a membrane separator used in the present electrolytic cell, a cation exchange membrane is employed as stated earlier. The typical examples are cation exchange membranes conveying cation exchange groups such as perfluorosulfonic acids or sulfonic acid groups of which are partly or wholly substituted by carboxylic acid groups, which are represented by "NAFION (registered trademark)" produced and sold by E. I. Du Pont de Nemours & Co., in the United States.

The electrolytic cell of the present invention is suitably used for the electrolysis of an aqueous alkali metal chloride solution. As an alkali metal chloride, there are included, for example, sodium chloride, potassium chloride, lithium chloride and the like. An aqueous solution containing these metal chlorides is supplied into the anode compartment as a solution to be electrolysed. On the other hand, as a cathode solution in the cathode compartment an aqueous alkali metal hydroxide produced by the electrolysis is used. Accordingly, as a solution supplied into the cathode compartment, is supplied water or a diluted alkali metal hydroxide solution as a diluting solution of the catholyte.

Hereinafter, the present invention will be described by way of drawings.

Figure 1:
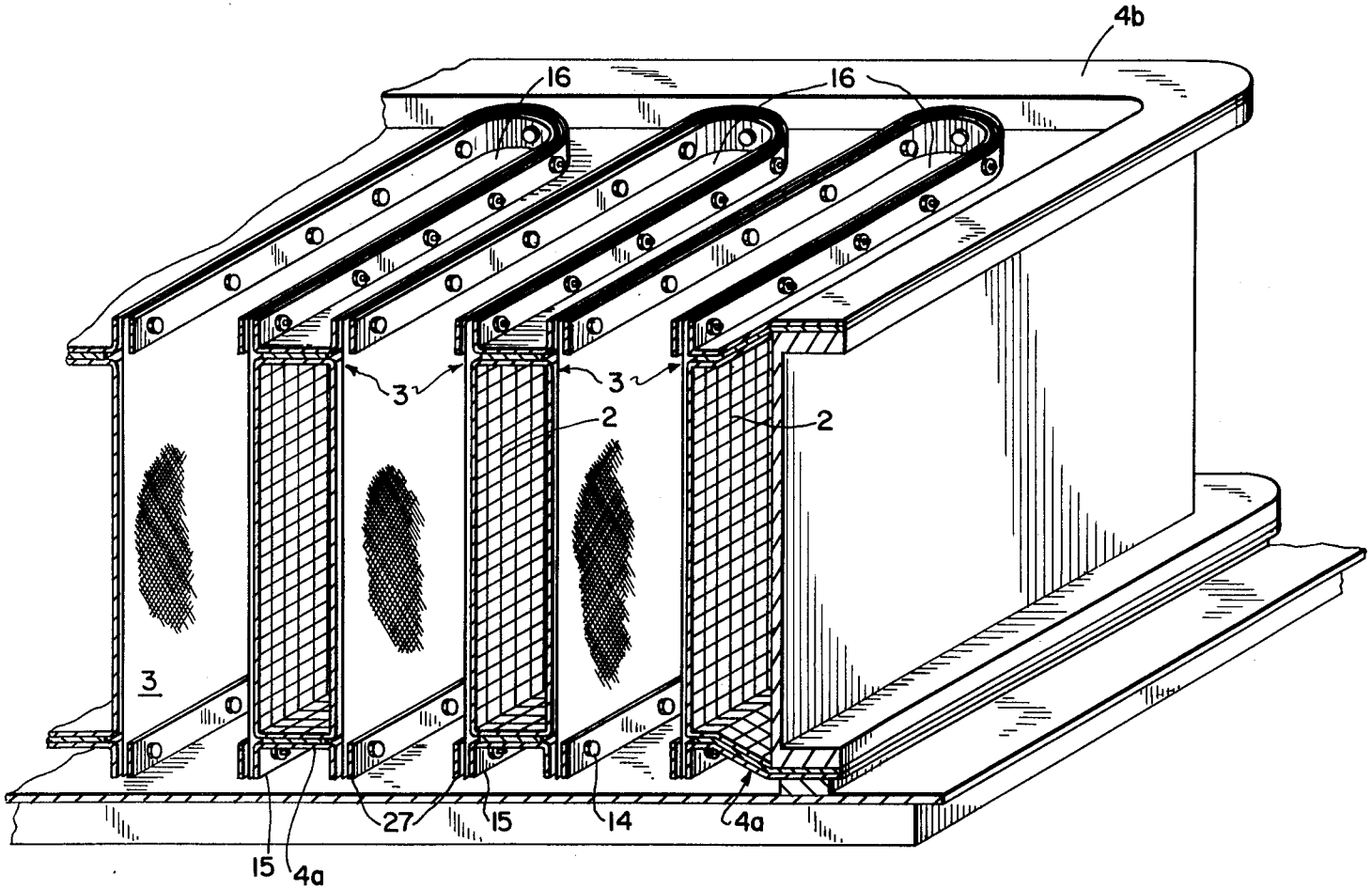
FIG. 1 is a partially longitudinal sectional perspective view of the cathode box of the electrolytic cell of the present invention.
Figure 2:
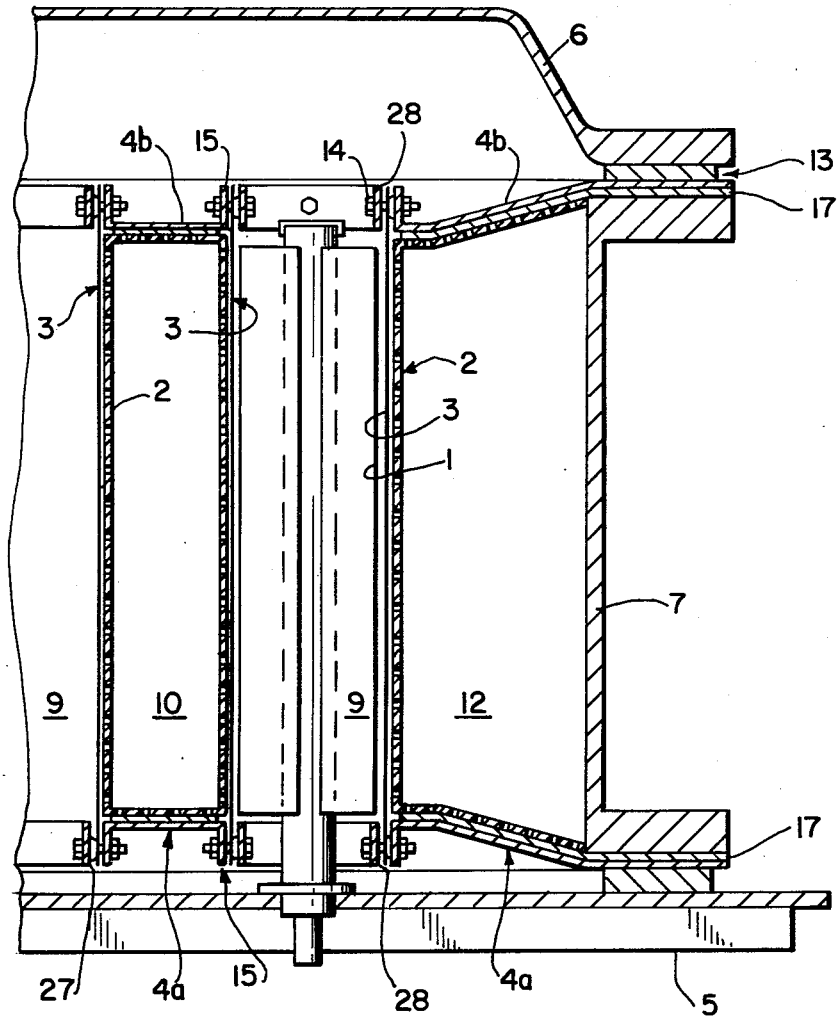
FIG. 2 depicts a partially longitudinal sectional view of a fabricated electrolytic cell.

Referring to FIG. 1 and FIG. 2, the numeral 1 is an anode, 2 is a cathode, 3 is a cation exchange membrane, 4b is an upper cation exchange membrane support, 4a is a lower cation exchange membrane support, 6 is a cell cover and 7 is a side wall of the cell. The anodes 1 are situated at equal intervals at a bottom plate 5 of the cell (it also serves as an electroconductive portion). To the inside circumferential surfaces of collars 15 which are located at the circumferential edges of openings of the cation exchange membrane supports 4a and 4b in which openings the anodes 1 are to be inserted, the cation exchange membrane 3 is secured. In the foregoing openings, the anodes 1 are inserted (namely, the anode is surrounded with the cation exchange membrane, then with the cathode) to form a unit anode 9 (an area where the cation exchange membrane encloses the anode, the same applies hereinafter) and a unit cathode 10, respectively. The unit anodes 9 are connected with each other at upper and lower portions, and the unit cathodes 10 are connected with each other at the circumferential portions. The anode compartment and the cathode compartment are separated from each other by the lower cation exchange membrane support 4a, the upper cation exchange membrane support 4b and the cation exchange membrane installed to the collars of the supports. The numeral 13 is a gasket and 17 is an insulating sheet placed between the flanges of the cathode box and the membrane supports. The numeral 27 is a pressing plate, 28 is a packing and 14 is a bolt by which the cation exchange membrane 3 is secured to the collars 15 of the membrane supports.

As the anode material there are included titanium clad with a thin coating of a platinum group metal or a platinum group metal oxide and the like. An anode having a function of expanding to the cathode during the electrolysis is preferred. As the cathode material there are included iron, nickel, or these metals clad with a thin coating of a platinum group metal or a porous nickel and the like to minimize hydrogen overvoltage. These may be used in various shapes such as an expanded metal, a wire netting, a foraminous plate, a rod and the like.

As the cathode box material, iron or stainless steel is preferably used. As regards cell cover, the inside surface enclosing the anode compartment 11 is made of a chlorine resistant material including a rubber or fluorocarbon resin lined iron. A chlorine resistant and heat resistant plastic such as FRP and CPVC may be preferably employed.

Figure 3:
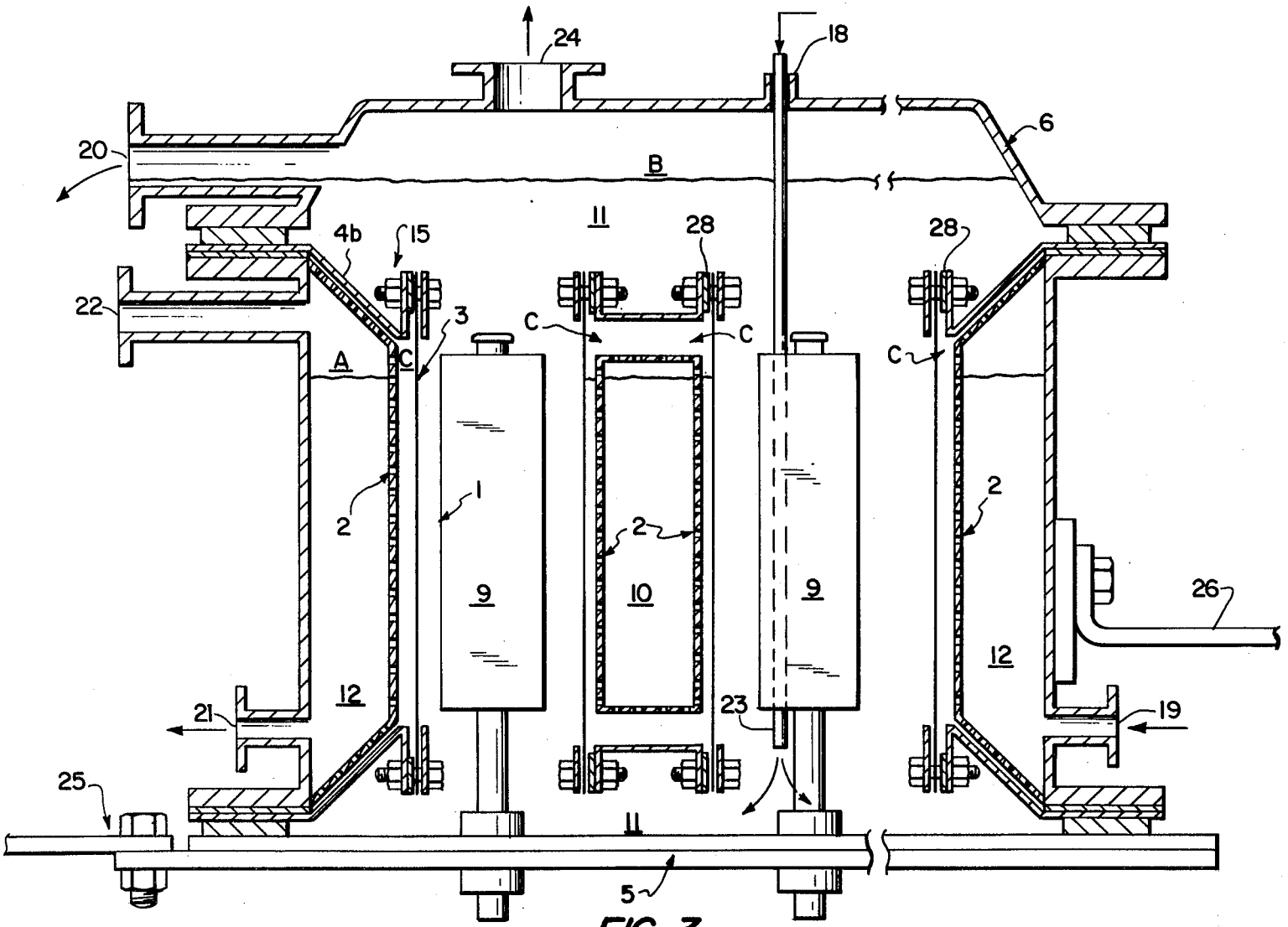
FIG. 3 is a longitudinal sectional view illustrating an embodiment of the electrolytic cell of the present invention.

In FIG. 3, the numeral 10 is a unit cathode shown in FIG. 1 and FIG. 2 and the numeral 9 is a unit anode depicted in FIG. 1 and FIG. 2. The numeral 18 is an anode solution inlet (i.e., an aqueous alkali metal chloride solution inlet), the numeral 19 is a cathode solution inlet (i.e., a diluted alkali metal hydroxide solution or a diluting water inlet) and the numeral 23 is an aqueous alkali metal chloride solution supply pipe. Each solution inlet is situated at a lower portion of the respective compartment. The numeral 20 is an anode solution outlet (i.e., a depleted brine outlet) and is located at an upper portion of the anode compartment. The numeral 21 is a cathode solution outlet (i.e., the product, an alkali metal hydroxide outlet) and is located at a lower portion of the cathode compartment 12 than the surface of the cathode solution (A). The numeral 22 is a cathode gas outlet (i.e., hydrogen outlet) and 24 is an anode gas outlet (i.e., chlorine gas outlet). The former is positioned at an upper portion of the cathode compartment 12 and the latter is positioned at an upper portion of the anode compartment (i.e., the cell cover 6). (During the course of electrolysis, the level of the cathode solution (A) does not ascend up to the level of the cathode gas outlet 22 because the cathode compartment 12 is maintained under an increased pressure by hydrogen gas. The increased pressure is effected by the use of a water seal pot, a control valve and the like.)

The numeral 5 is a bottom of the cell, 25 is a busbar of the anode compartment and 26 is a busbar of the cathode compartment. (B) is an anode solution level.

In the following, mention will be made of the electrolysis of an aqueous sodium chloride solution according to FIG. 3.

A saturated aqueous sodium chloride solution is supplied through the inlet 18, passes through the supply pipe 23 and then reaches a lower portion of the anode compartment. The solution is then electrolysed on the anode 1 to evolve chlorine gas. Sodium ion passes through the cation exchange membrane 3 to arrive at the cathode compartment. Sodium ion then reacts with hydroxyl ion generated concurrently with hydrogen gas on the cathode 2 to produce sodium hydroxide. The so obtained sodium hydroxide is diluted with pure water fed through the cathode solution inlet 19 to provide a 20% sodium hydroxide solution. Electric current is supplied from the anode compartment busbar 25 to the cathode compartment busbar 26.

The anode solution electrolysed in a unit anode (i.e., deplected brine) and evolved chlorine gas ascend upwardly to reach an upper portion higher than the upper end of the cathode compartment (i.e., the upper end of the unit cathode), and gas-liquid separation is readily effected at the surface of the anode solution (B). Chlorine gas separated is removed through the anode gas outlet 24 and the depleted brine is removed through the anode solution outlet 20.

On that occasion, since the anode solution outlet 26 is situated at an upper portion higher than the upper end of the cathode compartment (i.e., the upper end of the cation exchange membrane), chlorine gas evolved in the unit anode 9 is prohibited from passing through the cation exchange membrane to be dissolved in the cathode solution. Further, the anode solution supply pipe 23 reaches a lower portion of the anode compartment 11 so that the concentration of the anode solution both in the anode compartment 11 and in the unit anodes 9 is maintained uniform and a good circulating movement of the anode solution is resulted.

On the other hand, a diluted aqueous sodium hydroxide solution or a diluting water of the cathode solution is introduced through the cathode solution inlet 19 and flows from a lower portion of the cathode compartment 12 into the unit cathodes 10 where sodium ion generated by the electrolysis in the unit anodes and reached by the passage through the cation exchange membrane reacts with hydroxyl ion to be sodium hydroxide and simultaneously hydrogen gas evolves. The aqueous sodium hydroxide solution concentrated to 20% is removed through the cathode solution outlet 21 and evolved hydrogen gas goes up to an upper portion of the cathode compartment 12, then is separated readily from the cathode solution at the surface of the cathode solution (A), thereafter discharged through the cathode gas outlet 22.

On that occasion, the cathode solution outlet 21 is positioned in the neighborhood of the lower portion of the cathode compartment 12 [i.e., at a lower portion than the surface of the cathode solution (A)] so that the separation of hydrogen gas evolved in the unit cathodes 10 from the cathode solution is conducted at an upper portion of the cathode compartment 12. Hence, neither separating operation outside the electrolytic cell nor a gas-liquid separator is necessitated and thus being exceedingly advantageous in industry. In addition, as the cathode solution inlet 19 is positioned at a lower portion of the cathode compartment 12, not only is the concentration of the cathode solution both in the cathode compartment 12 and in the unit cathodes 10 kept uniform, but also the circulating movement of the cathode solution is well carried out.

Furthermore, chlorine gas is sucked with a negative pressure of 30 mm $H_2O$ while hydrogen gas is under an increased pressure of 120 mm $H_2O$. The height from the cathode solution level (A) to the anode solution level (B) is 130 mm $H_2O$ and the apparent specific gravity of the anode solution is 1.05, and thus a net pressure exerted on the portion C of FIG. 3 (i.e., hydrogen containing space above the uppermost end of the cation exchange membrane) being calculated as below;

$$(120+30)-130\times1.05\approx13.5 \text{ mm } H_2O$$

The net pressure of as small as 7 mm $H_2O$ is only exerted on the cathode compartment so that there is substantially no leakage of hydrogen gas from the sealed portion of the collars 15 of the upper membrane support **4*b* and the cation exchange membrane 3**, thereby resulting in safe operation.

Hereinabove, mention was made of the case where one solution inlet, one solution outlet and one gas outlet were provided respectively to each compartment, but the present invention, of course, includes the cases where two or more solution inlets, two or more solution outlets and two or more gas outlets are provided to the respective compartment, by which an aqueous alkali metal hydroxide of a higher quality is obtained with the by far superior effects of the present invention.

What we claim is:

1. A vertical and monopolar box type electrolytic cell for the electrolysis of an aqueous alkali metal chloride solution providing a cation exchange membrane as a separator between anodes and cathodes, which comprises an anode compartment having at least one anode solution inlet, at least one anode solution outlet and at least one anode gas outlet, respectively, and a cathode compartment having at least one cathode solution inlet, at least one cathode solution outlet and at least one cathode gas outlet, respectively, said anode solution outlet is positioned in such a manner that the ratio of height of anode solution level to that of cathode solution level is more than one, the anode gas pressure in the anode compartment is under a negative pressure, the cathode gas pressure in the cathode compartment is under a positive pressure, and the product of a difference in height between the cathode solution level and the anode solution level and an apparent specific gravity of the anode solution is less than the sum total of an anode compartment inside pressure in the positive numerical value of a given negative pressure value and a cathode compartment inside pressure during the course of the operation and the cathode solution inlet and outlet are positioned at a lower portion of the cathode compartment.

2. A vertical and monopolar box-type electrolytic cell for the electrolysis of an aqueous alkali metal chloride solution providing a cation exchange membrane as a separator between anodes and cathodes, which comprises an anode compartment having at least one anode solution inlet, at least one anode solution outlet, and at least one anode gas outlet, respectively, and a cathode compartment having at least one cathode solution inlet, at least one cathode solution outlet, and at least one cathode gas outlet, respectively, said anode solution outlet being positioned in such a manner that the ratio of height of anode solution level to that of cathode solution level is more than one, the anode gas pressure in the anode compartment is under a negative pressure, the cathode gas pressure in the cathode compartment is under a positive pressure, and $$0\leqq\{Pc+Pa\}-H\times\rho\leqq30 \text{ mm } H_2O$$

wherein

Pc is cathode gas pressure (mm $H_2O$),

Pa is anode gas pressure in the positive numerical value (mm $H_2O$),

H is difference in height between anode solution level and cathode solution level (mm), and $\rho$ is the apparent specific gravity of the anode solution.

3. The vertical and monopolar box type electrolytic cell of claim 2, wherein the anode solution outlet is positioned at an upper portion of the anode compartment, said upper portion being higher than the upper end of the cation exchange membrane.

4. The vertical and monopolar box type electrolytic cell of claim 2, wherein the anode solution outlet also serves as the anode gas outlet.

* * * * *